US008065876B2

(12) United States Patent
Walpita

(10) Patent No.: US 8,065,876 B2
(45) Date of Patent: Nov. 29, 2011

(54) HEAT ENGINE IMPROVEMENTS

(75) Inventor: Nalin Walpita, Somerville, MA (US)

(73) Assignee: Solartrec Inc., Somerville, MA (US)

( * ) Notice: Subject to any disclaimer, the term of this patent is extended or adjusted under 35 U.S.C. 154(b) by 472 days.

(21) Appl. No.: 12/246,127

(22) Filed: Oct. 6, 2008

(65) Prior Publication Data

US 2010/0083658 A1 Apr. 8, 2010

Related U.S. Application Data

(63) Continuation-in-part of application No. 11/512,568, filed on Aug. 30, 2006, now Pat. No. 7,536,861.

(60) Provisional application No. 60/719,328, filed on Sep. 21, 2005, provisional application No. 60/719,327, filed on Sep. 21, 2005.

(51) Int. Cl.
*F01B 29/10* (2006.01)

(52) U.S. Cl. ..... 60/512; 60/514; 60/515

(58) Field of Classification Search ..... 60/508–515, 60/641.8–641.15
See application file for complete search history.

(56) References Cited

U.S. PATENT DOCUMENTS

| | | | | |
|---|---|---|---|---|
| 0,659,450 | A | 10/1900 | McHenry | |
| 2,791,881 | A * | 5/1957 | Denker | 60/619 |
| 3,939,819 | A | 2/1976 | Minardi | |
| 4,024,715 | A * | 5/1977 | Scragg et al. | 60/641.15 |
| 4,103,151 | A | 7/1978 | Chromie | |
| 4,135,367 | A * | 1/1979 | Frosch et al. | 60/641.15 |
| 4,144,716 | A | 3/1979 | Chromie | |
| 4,195,481 | A | 4/1980 | Gregory | |
| 4,198,826 | A | 4/1980 | Chromie | |
| 4,209,983 | A | 7/1980 | Sokol | |
| 4,229,076 | A | 10/1980 | Chromie | |
| 4,259,841 | A * | 4/1981 | Thomas | 60/669 |
| 4,423,599 | A | 1/1984 | Veale | |
| 4,471,617 | A | 9/1984 | De Beer | |
| 4,601,170 | A | 7/1986 | Flege | |
| 4,636,325 | A | 1/1987 | Greene | |
| 4,788,823 | A | 12/1988 | Johnston | |
| 4,821,516 | A | 4/1989 | Isshiki | |
| 4,981,014 | A * | 1/1991 | Gallagher | 60/412 |
| 5,101,632 | A | 4/1992 | Aspden | |
| 5,809,784 | A | 9/1998 | Kreuter | |
| 6,128,903 | A | 10/2000 | Riege | |
| 6,272,855 | B1 | 8/2001 | Leonardl | |
| 6,282,894 | B1 * | 9/2001 | Smith | 60/509 |
| 6,442,937 | B1 | 9/2002 | Stone et al. | |

(Continued)

FOREIGN PATENT DOCUMENTS

JP 8233373 9/1996

*Primary Examiner* — Hoang Nguyen
(74) *Attorney, Agent, or Firm* — Foley & Lardner LLP; Matthew L. Fenselau

(57) ABSTRACT

An engine and a method for operating the engine comprising a chamber defined by at least one fixed wall and at least one movable wall, the volume of the chamber variable with movement of the movable wall; an injector arranged to inject liquid into the chamber while the chamber has a substantially minimum volume; apparatus through which energy is introduced that is absorbed by the fluid which then explosively vaporizes, performing work on the movable wall; and apparatus which returns the movable wall to a position prior to the work being performed thereon so the chamber has the substantially minimum volume, substantially evacuating the chamber of vaporized fluid without substantially compressing the vaporized fluid.

19 Claims, 11 Drawing Sheets

U.S. PATENT DOCUMENTS

| | | | |
|---|---|---|---|
| 6,568,386 | B2 | 5/2003 | Agata |
| 6,735,946 | B1 | 5/2004 | Otting et al. |
| 6,786,045 | B2 | 9/2004 | Letovsky |
| 7,051,529 | B2 | 5/2006 | Murphy et al. |
| 7,084,518 | B2 | 8/2006 | Otting et al. |
| 2004/0154299 | A1 | 8/2004 | Appa et al. |
| 2009/0100832 | A1 * | 4/2009 | Loeffler ..... 60/512 |

* cited by examiner

HEAT ENGINE IMPROVEMENTS

RELATED APPLICATIONS

This application claims priority under 35 U.S.C. §119(e) to U.S. Provisional Application Ser. No. 60/719,327, entitled "PIEZOELECTRIC SELECTABLY ROTATABLE BEARING," filed on Sep. 21, 2005, and Application Ser. No. 60/719,328, entitled "SOLAR HEAT ENGINE SYSTEM," filed on Sep. 21, 2005, both of which are herein incorporated by reference in its entirety.

This application claims the benefit under 35 U.S.C. §120 of U.S. application Ser. No. 11/512,568, entitled "SOLAR HEAT ENGINE SYSTEM," filed on Aug. 30, 2006, which is herein incorporated by reference in its entirety.

BACKGROUND

This disclosure relates to the conversion of heat energy to mechanical energy. The disclosure further relates to such conversion where the heat energy source is concentrated solar energy.

Several different types of heat engines have been used in practice to convert concentrated solar radiation to mechanical power, notably Stirling cycle engines and Rankine cycle engines, however, all such known engines have had disadvantages relating to complexity, cost or low efficiency. Apparatus which convert heat energy into mechanical energy, namely the heat energy of concentrated beam of solar radiation into the movement of a piston through the explosion or expansion of a droplet of substantially uncompressed liquid targeted by the concentrated solar beam are described in patent application Ser. No. 11/512,568, referred to above. In patent application Ser. No. 11/512,568, a method of utilizing a droplet or thin film of water or other liquid, which is heated and explosively expanded in a six-sided expander, is described. The six-sided expander absorbs substantially all of the energy in the droplet and converts a large fraction of that energy to mechanical power through the motion of a linear piston. Mechanical power is in turn converted to electrical power by a linear generator on each of the six sides complete with field excitation and output coil.

In theoretical, conventional Rankine cycles, expansion of working fluid takes place under reversible adiabatic conditions. Also in conventional Rankine cycles as applied to solar energy conversion, the fluid is first vaporized in a boiler then passed into an expander.

Methods whereby liquid is injected into a working space above a piston have also been described. Conventionally, the hot liquid vaporizes at the point of injection, with consequent loss of available energy or exergy. Some of the initial energy loss on vaporization of liquid injected into the cylinder may be regained as heat transferred from the compressed vapor already within the cylinder; however, the energy thus transferred comprises no net heat addition from outside but merely constitutes energy re-circulated within the system. Such recirculation cannot, of itself, produce a useful energy output by the system.

Thus, in the liquid injection prior art, fluid is injected, with exergy loss into a chamber, during which relatively uncontrolled vaporization takes place reducing the amount of available energy, then work is done by adding heat back into the already partially expanded vapor to cause the further expansion of the vapor which moves a piston to perform useful work.

SUMMARY OF THE INVENTION

In one practical embodiment, a concentrated beam of solar radiation is directed through a high temperature resistant window, for example, of sapphire or any other suitable material, onto a thin film or droplet of water. The thin film or droplet can be sitting on or near a "target" disk or plate. The target disk or plate can be a material with high absorptivity, high emissivity in the near and far infra red range and very high surface area. The thin film or droplet of liquid is heated and subsequently expanded or exploded, to provide mechanical power.

Some embodiments use a boiler-less, thermodynamic cycle in which the working fluid is heated in contact with the expansion system and the expansion takes place whilst heat input is still going on. Fluid heating takes place at near constant volume, and with substantially no pre-compression resulting in achievement of pressures much higher than conventional Rankine cycles. Also, uniquely, expansion and heating take place on the constant pressure, constant temperature line in the liquid T-s and h-s diagrams, unlike in conventional, Rankine cycle devices hitherto described in the prior art.

According to some embodiments, another part of the cycle comprises a constant volume heat recovery which pre-heats the unexpanded working fluid, while the exhausted, expanded working fluid experiences a constant pressure and constant temperature compression back to the liquid state. Due to the aforementioned heat recovery step whilst exhausting, in a particularly efficient embodiment, the cycle will receive input energy during the expansion process only.

According to an embodiment, an engine comprises a chamber defined by at least one fixed wall and at least one movable wall, the volume of the chamber variable with movement of the movable wall; an injector arranged to inject liquid into the chamber while the chamber has a substantially minimum volume; apparatus through which energy is introduced that is absorbed by the fluid which then explosively vaporizes, performing work on the movable wall; and apparatus which returns the movable wall to a position prior to the work being performed thereon so the chamber has the substantially minimum volume, substantially evacuating the chamber of vaporized fluid without substantially compressing the vaporized fluid.

According to another embodiment, a method of converting energy from one form to another in a system comprises confining a quantity of substantially unexpanded liquid within a chamber; adding energy to the system, so as to heat the liquid sufficiently to vaporize the liquid and expand a resulting vapor; and receiving mechanical energy from the expanding vapor in a form of movement of a wall of the chamber responsive to the expansion.

According to yet another embodiment, a method of converting energy from one form to another by passing a working material through a closed liquid-vapor thermodynamic cycle, comprises expanding the working material from a liquid phase into a vapor phase by addition of heat; recovering heat from the working material in the vapor phase so as to condense the working material from the vapor phase into the liquid phase to await expansion; and adding the recovered heat to working material awaiting expansion, without changing the phase thereof.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
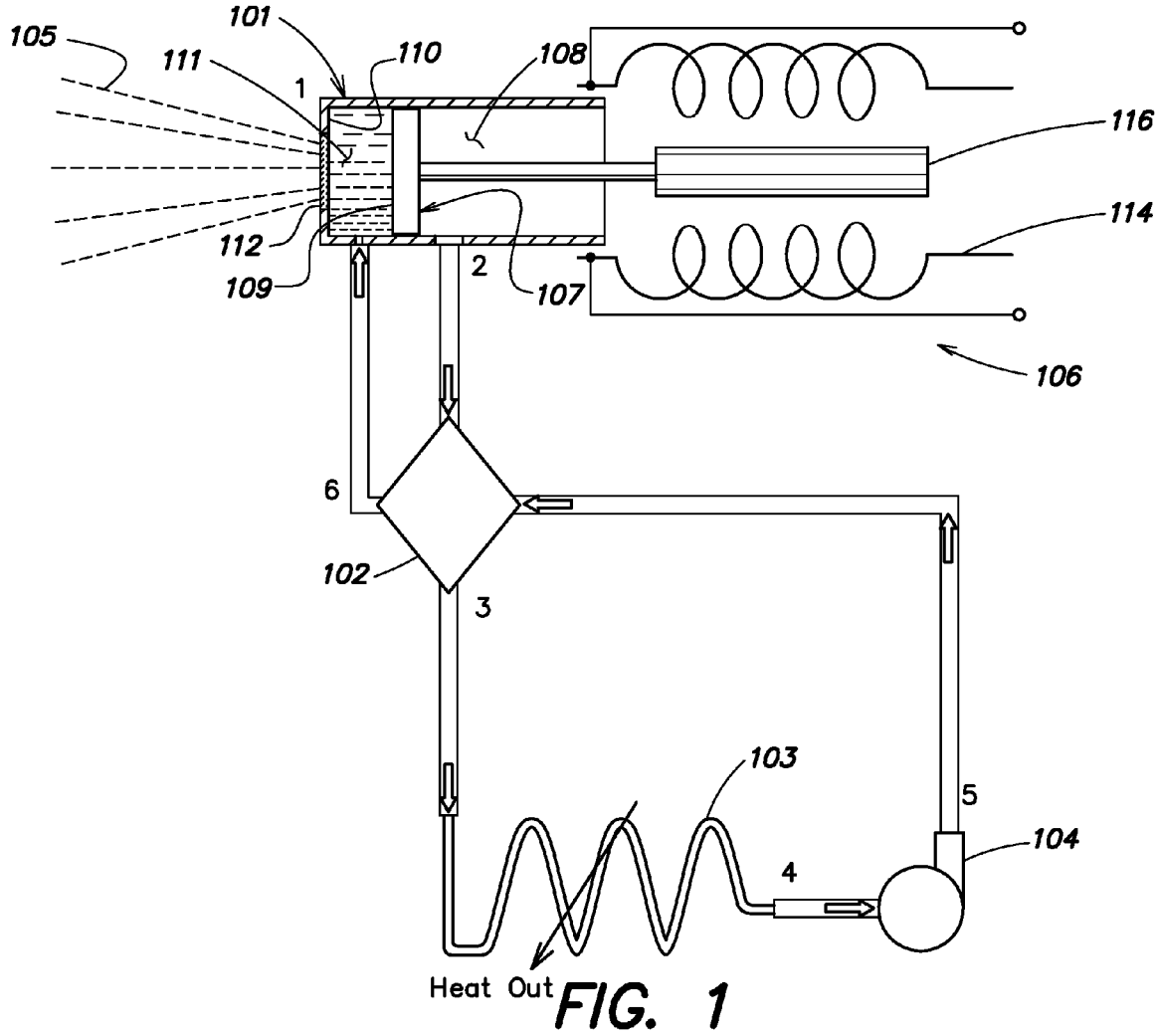
FIG. 1 is an overall schematic of a system implementing a proposed thermodynamic cycle showing the major elements.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

A single sided expander and its working cycle is now described. The single sided expander includes an oscillating piston and linear electrical generator. The single sided expander is derived from actual experimental rig results. It will be understood that expanders operating on the principles illustrated by the single-sided expander but employing more than one moveable wall element are possible. Moreover, the single sided expander is described in the context of a cylindrical chamber having a piston which moves to vary the size of the chamber; however, it will be understood that other expander configurations are possible, for example based on a rotary configuration similar to the Wankel internal combustion engine, which also has an expansion chamber having a single side which moves to vary the size of the chamber. Any suitable expander chamber configuration in which the expander chamber varies in size responsive to the force of the expanding vapor within and which is returned to a starting position by excess energy temporarily stored in a flywheel or other device for the purpose.

The operating thermodynamic cycle for the expanders, according to various embodiments, is a closed cycle, having relatively high conversion efficiency. It will be contrasted with a conventional Rankine thermodynamic cycle. It is based on the heating and expansion of a droplet or thin film of any suitable liquid, without any substantial pre-compression of the liquid or any substantial pre-compression of any gas surrounding the liquid.

Figure 2:
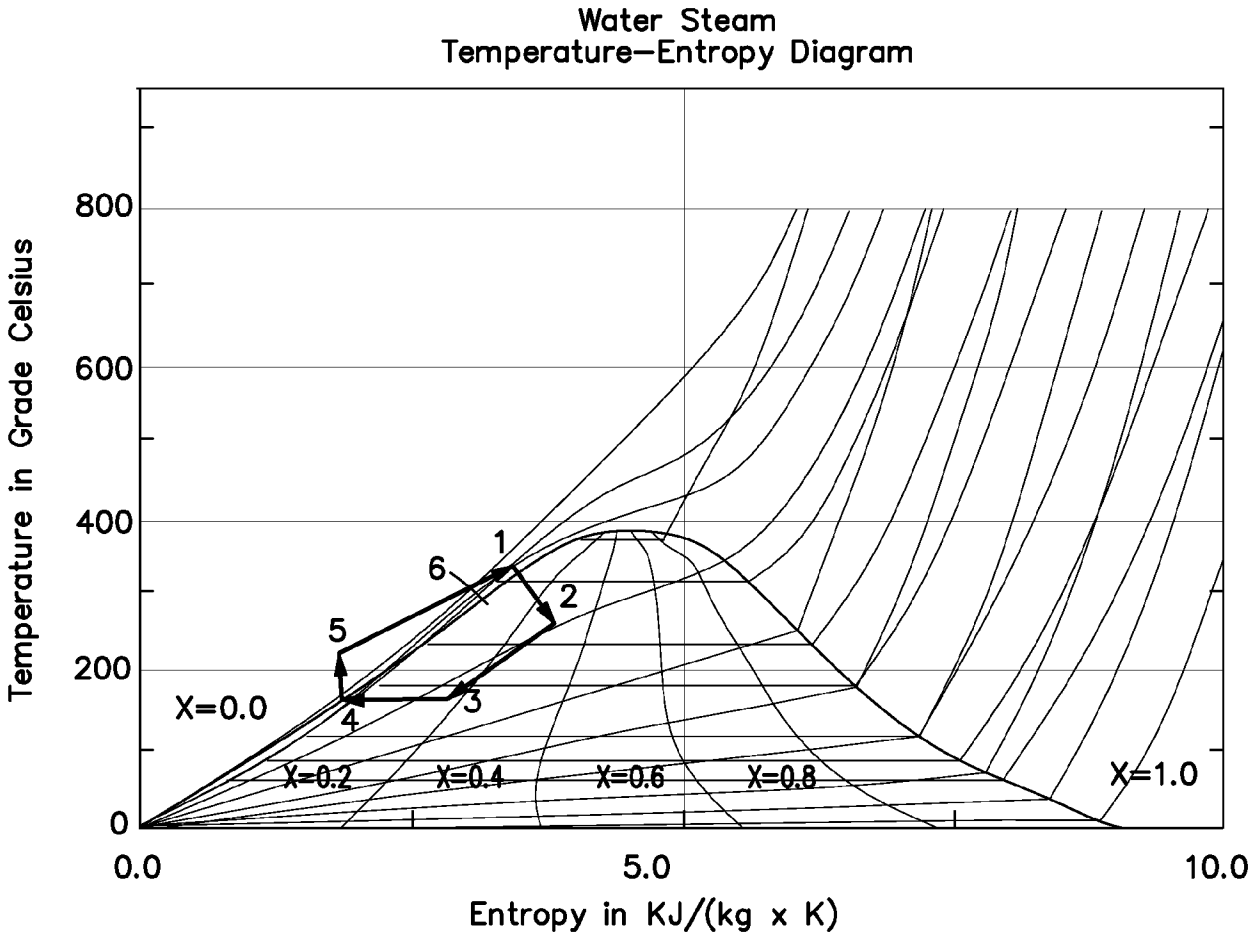
FIG. 2 depicts the thermodynamic cycle laid out on a steam T-s diagram.

Reference will now be made to FIG. 1, which is a schematic and FIG. 2, a thermodynamic cycle diagram superimposed on a Temperature-entropy (T-s) diagram. Referring to FIG. 1, the heat engine comprises four main elements, a piston type expander 101, a heat exchanger 102, a vapor condenser 103, a liquid pump 104 an incoming concentrated solar beam 105 and a linear generator 106. Each element is more fully described below. Points of transition on the T-s diagram of FIG. 2 denoted by single-digit reference numbers are also indicated in FIG. 1 at locations which indicate where in the exemplary apparatus each point in the thermodynamic cycle is achieved.

The Expander 101 includes a piston 107 in a cylinder 108, the piston having a piston top 109, which forms a suitable cavity boundary, together with the cylinder 108 and a cylinder head 110. When it is in top dead centre (TDC) position a water droplet or film 111 is injected into this cavity, with necessary propellant force being provided by the liquid pump 104.

A concentrated solar beam 105 is applied intermittently through a sapphire window 112 or other means provided in the cylinder head 110, such that the trapped water droplet or film 111 is vaporized and expands against the piston top 109, producing mechanical power, during an expansion stroke. See also FIG. 4. The expansion stroke, also referred to herein as Process 1-2, is depicted as a line 1-2 in the T-s chart in FIG. 2. This expansion stroke is initiated by and continues during the input of heat to the working fluid to produce mechanical power through P·dV work on the piston. In contrast, Rankine cycle engines separate the input of heat energy to the working fluid (e.g., in a boiler) and the extraction of mechanical work therefrom (e.g., in an expansion cylinder).

In addition to utilizing a beam of concentrated solar radiation, any other suitable method of introducing heat into the chamber may be used. For example, a heat exchanger with flow passages on the outside of the chamber may be configured to heat up a flat surface or surface with enhanced area (e.g., textured to have additional surface area), which is directly in contact with the water film inside the cylinder and trapped between piston and cylinder head. Alternatively, a porous block or plate may be fitted between the piston and cylinder head. The porous block, which, as a result of its porosity, has a very substantial surface to volume ratio, can be heated by applying heat externally, which is then transferred through the cylinder head into the block. In yet another alternative, a series of heat pipes embedded in the cylinder head, may enable heat to be transferred at a very high rate from external sources. This last alternative can be combined with the use of the porous block or heat transfer surface explained above.

Figure 4:
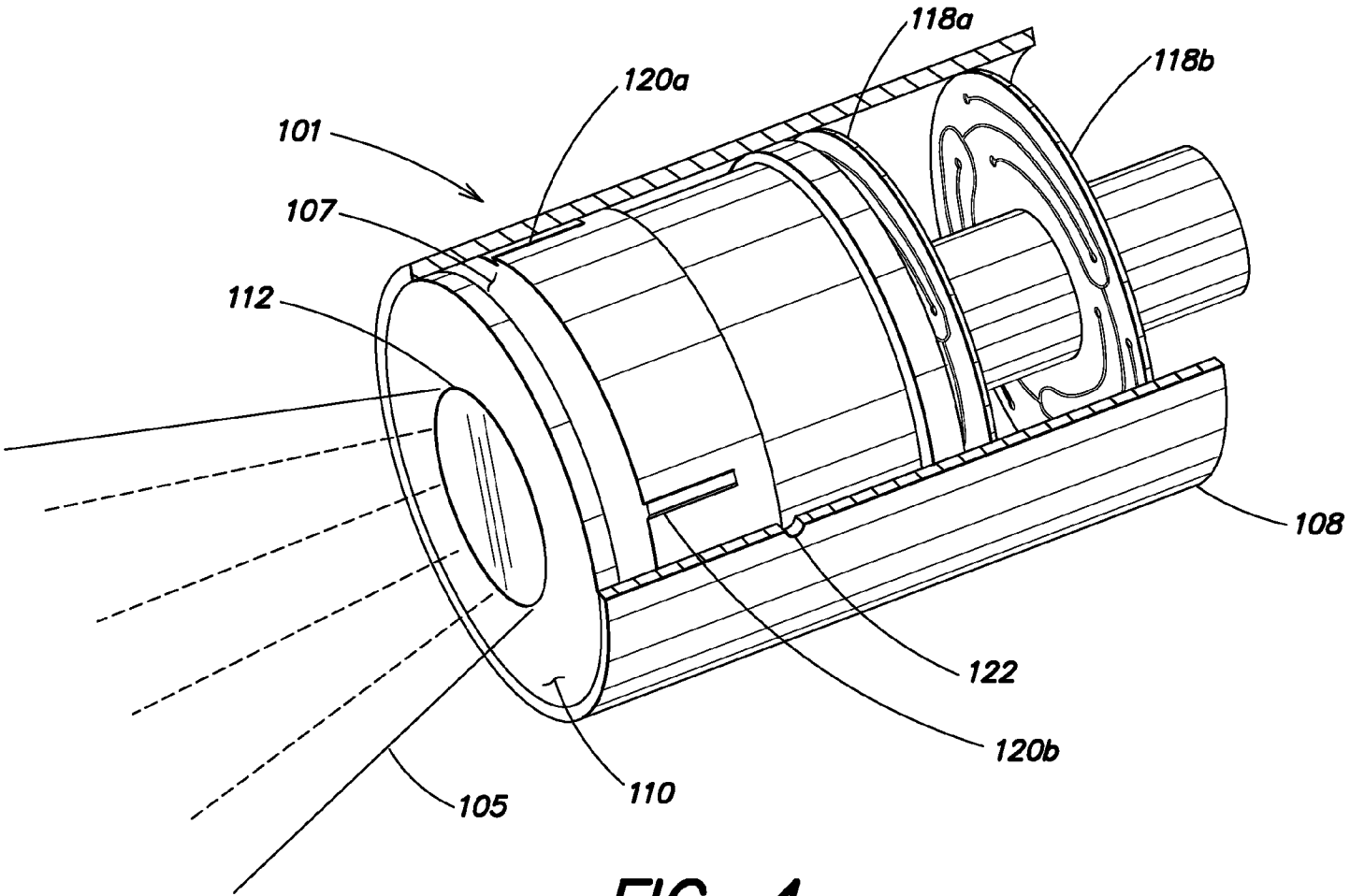
FIG. 4 is a schematic showing a solar beam entering an exemplary expansion chamber through a sapphire window.
Figure 5:
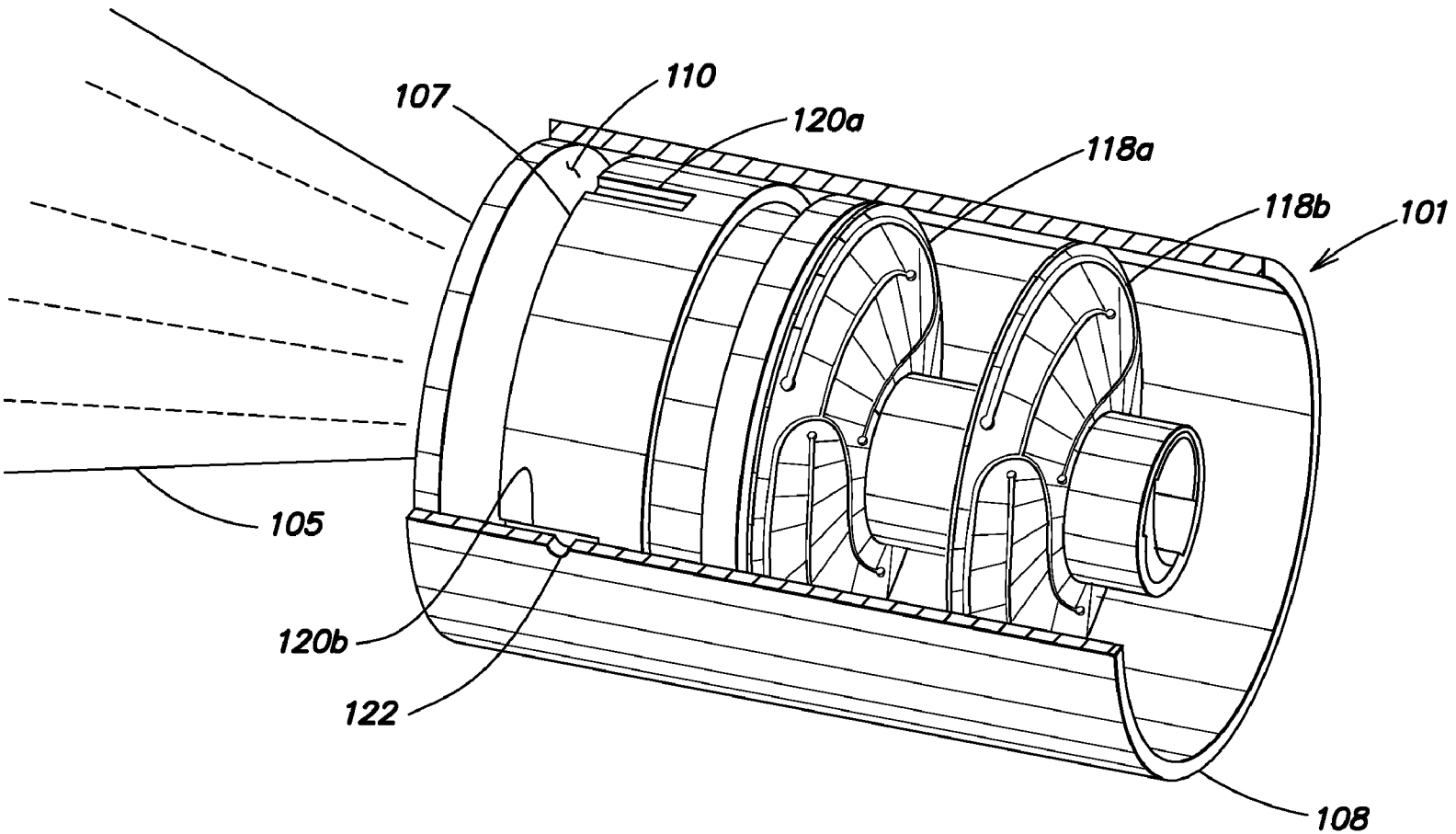
FIG. 5 is a perspective view of a cylinder and piston system showing a valving method according to some embodiments.

Exhaust of spent vapor at point 2 on the T-s diagram is carried out by a rotation of the piston such that exhaust ports 122 on the cylinder wall line up with grooves 120*a* and 120*b* in the piston, as shown in FIGS. 4 and 5. Rotation of the piston, as well as its return to TDC, is achieved by means of springs 118*a* and 118*b* configured to provide rotation as they flex along the axis of the piston 107. Spent vapor is exhausted through heat exchanger 102, which enables recovery of heat from spent vapor into condensed liquid awaiting injection into the cylinder 108. Spent vapor exhaust, also referred to herein as Process 2-3, is indicated as a constant volume process by line 2-3 in the T-s diagram.

In addition to piston rotation, any other suitable method for exhausting spent vapor may be used. For example, a poppet type valve can be disposed in the cylinder head, operated by a solenoid, mechanical lifters or any other suitable means. Alternatively, a valve can comprise a combination of a slot in the piston together with a slot disposed in a rotating sleeve disposed to the outside of the piston. The rotating sleeve may comprise the whole of the cylinder. A cyclical rotation of the sleeve can alternately bring into alignment and take out of alignment the slot in the piston wall in relation to the corresponding slot in the cylinder wall. In yet another alternative, a poppet valve may be disposed on the top surface of the piston, exhausting spent vapor to the area behind the piston. This last alternative has some advantages, notably that the constant pressure condensation step (step 4-5 in FIG. 4) can take place during the expansion step. The heat recovery heat exchanger can, in this alternative, be installed within the expander, leading to greater compactness and lowered weight.

Spent vapor can be condensed, also referred to herein as Process 3-4, prior to re-injection into the cylinder, for example, in condenser 103. The process pathway is given as line 3-4 in the T-s diagram. The spent vapor condensation, Process 3-4, is represented as a constant pressure process. At point 4, the spent vapor is wholly in liquid form, ready for injection into the expander cylinder to start a new cycle. Thus, a continually refreshed supply of working fluid is not required, as the cycle is closed.

Condensed liquid from the condenser 103 is pumped up to injection pressure by means of pump 104, through heat exchanger 102 and then injected into cylinder 108 as a liquid droplet or thin film. The heat exchanger 102 permits otherwise wasted heat in the vapor to be recovered for the useful purpose of increasing the energy available in the next expansion cycle, rather than simply disposing of waste heat. This part of the cycle is indicated as lines 4-5 (liquid pumping, Process 4-5) and 5-6 (constant volume heat gain, Process 5-6), in the T-s diagram. Notably, because the heat recovered by the heat exchanger 102 provides insufficient energy to the liquid to vaporize the liquid prior to or during injection into the cylinder 108, the full energy of expansion of the liquid into expanded vapor after adding some quantum of externally supplied heat is available to perform work on the piston 107.

The inventive cycle is distinguished from conventional Rankine cycles in part by eliminating the boiler and also because inward heat transfer occurs while the working fluid is in the cylinder 108. Other differences include the presence of two constant volume heat transfer processes, (1) Process 2-3, and (2) Process 5-6, in the T-s diagram, and a low pressure compression step, 3-4. The portion 6-1 is an external heat addition step, because the total recovered heat in the 5-6 step is insufficient to heat the condensed fluid awaiting expansion to the fluid's saturation temperature at point 1.

In comparison with conventional Rankine cycles, the ability to do external work during the heat addition process has not previously been considered practical by those skilled in this art, possibly because of the difficulty of implementation. The described and heretofore unknown embodiment, and the variations suggested herein, each demonstrate a way to accomplish this useful result.

Figure 3:
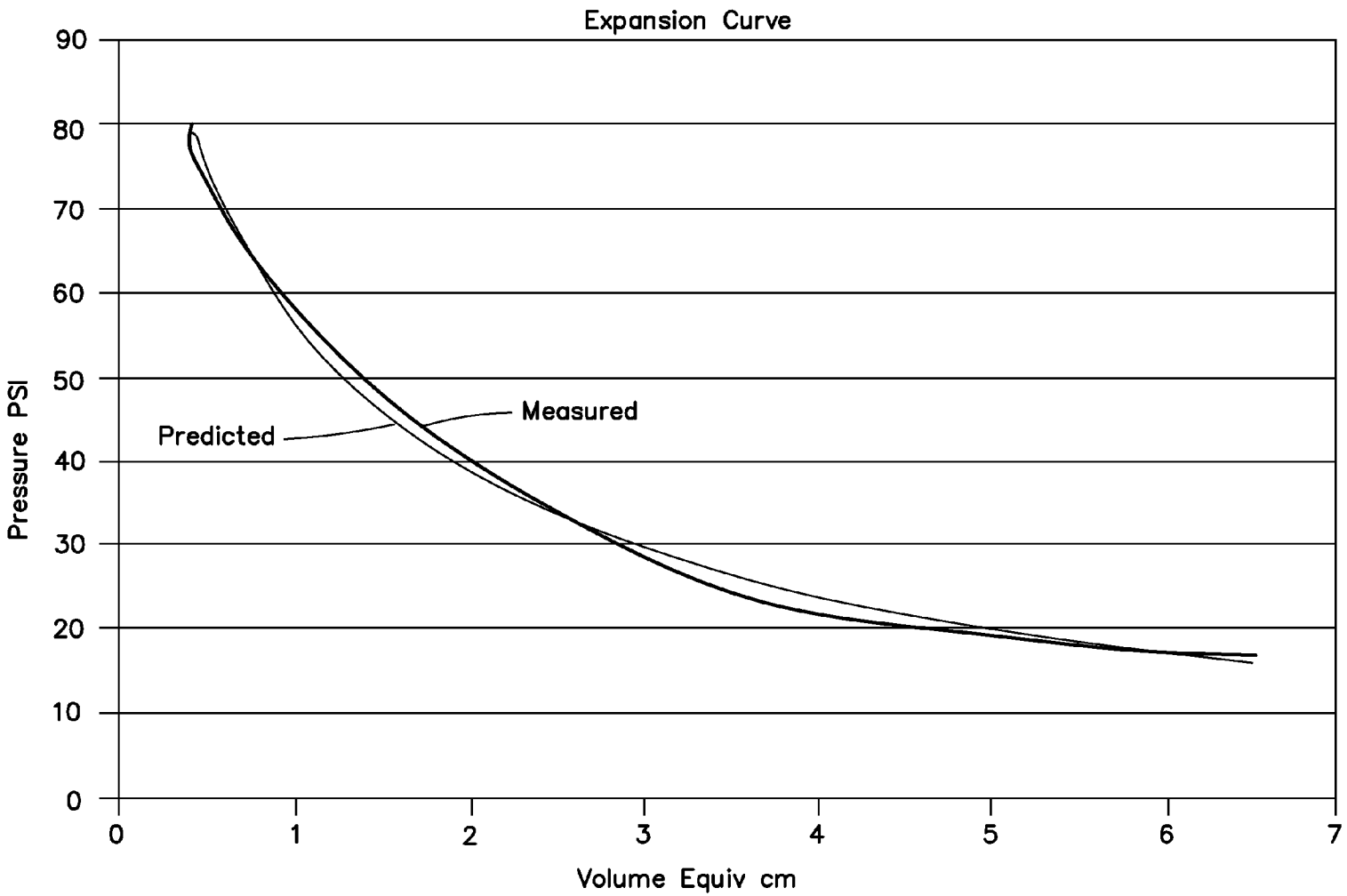
FIG. 3 is a graph of a typical measured and predicted expansion curve derived from experimental rig operation.

In contrast with conventional Rankine cycles a very high expansion ratio is achieved by embodiments in a single cylinder. Because the working fluid is expanding directly from a condensed liquid state to vapor within the cylinder of the expander, expansion ratios of over 80:1 may be achieved in a single cylinder with a four inch diameter and 5 inch stroke. See FIG. 3. This is quite remarkable compared to conventional steam reciprocating engines, which barely achieve expansion ratios of between 5:1 or 8:1 in a single cylinder; and also compared to internal combustion engines achieve at best expansion ratios of between 12:1 or 15:1. High conversion efficiency in internally heated cycles depends on two main elements; a high initial gas phase temperature and pressure and a high expansion ratio. In the present cycle, a very high expansion ratio has been achieved in one single cylinder with a relatively short stroke.

Embodiments further employ a single piston on a rod; to the opposite end of this rod a linear generator 106 is mounted, capable of absorbing mechanical energy produced and converting that mechanical energy in the form of motion to electrical energy, at high efficiency. The linear generator consists of permanent magnet 116 and/or coil 114 type system for excitation field and a coil 114 based electrical output system, with necessary software based field current control for production of sinusoidal power output. A rotary crank and suitable connecting rod can also permit connection to a conventional, rotary generator.

In general terms, the invention consists of a unique liquid film-based, constant-temperature, wet-region, expansion heat engine device, running on a unique, hitherto unexploited thermodynamic power cycle, with heating during expansion resulting in an expansion with no internal energy change, constant volume heat transfer, isothermal compression, leading to very high conversion efficiency.

The theoretical basis for the operation of the inventive engine is now presented using non-flow, $1^{st}$ Law analyses. The theoretical underpinning of each of the processes discussed above is given.

Process 1-2:

$$Q_{1\text{-}2}-W_{1\text{-}2}=\delta U_{1\text{-}2}$$

In the general case, δU is non zero. Therefore, rearranging, the heat input during Process 1-2 is $$Q_{1\text{-}2}=W_{1\text{-}2}+(U_2-U_1)$$

Process 2-3:

$$Q_{2\text{-}3}=(U_2-U_3)$$

Process 3-4:

$$Q_{3\text{-}4}-W_{3\text{-}4}=U_4-U_3$$

Process 4-5:

This process constitutes pressurization of the liquid to operating pressure P1 and is a work input term. Since the pressurization is being done on a liquid and not vapor, the magnitude of this term is usually low.

$$W_{4\text{-}5}=(P_1-P_3)\times v1$$

Process 5-6:

This process constitutes a constant volume heat gain to the pressurized liquid and receives heat from the heat output process of process 2-3. No external or internal work is done, in this process. This is the transfer of heat from spent vapor which is to be condensed back to liquid (for subsequent injection into the expander), into the liquid that is presently awaiting injection into the expander, thus recovering heat that would otherwise be discarded as waste heat. Since the working fluid at 6 is in liquid form whereas the working fluid at 2 is a mixture of vapor and liquid, the total quantum of heat that may be recovered and introduced to the liquid in the process 5-6 is limited by the fluid temperature at 2.

$$\text{Therefore, } Q_{5\text{-}6}=Q_{2'\text{-}3},$$

where point 2' represents the liquid condition pertaining to the pressure and temperature at point 6. Therefore the internal energy at 6 is given by $$U_6=(U_{2'}-U_4)+U_5$$

Generally $U_5=U_4$, hence $$U_6=U_{2'}$$

To bring the working fluid up to the working temperature and pressure, additional heat input, for example by transferring into the expansion chamber concentrated solar energy, is required, as follows:

$$Q_{6\text{-}1}=U_1-U_6$$

Hence $$Q_{6\text{-}1}=U_1-U_{2'}$$

Therefore total heat input to the cycle is $$Q_{in\ total}=Q_{6\text{-}1}+Q_{1\text{-}2},$$

or $$Q_{in\ total}=(U_1-U_2)+W_{1\text{-}2}+(U_2-U_1).$$

Hence, $$Q_{in\ total}=(U_2-U_{2'})+W_{1\text{-}2}.$$

Thus, $$Q_{in\ total} = W_{1-2} + (U_2 - U_{2'}).$$

Net work output from the cycle is given by $$W_{out\ net} = W_{1-2} - (W_{3-4} + W_{4-5}).$$

In the thermodynamic cycle disclosed, the heat input is equal to the gross work output plus a difference in the recovered energy in the constant volume heat transfer and the net work output is equal to gross work out less the low pressure vapor compression work and the liquid compression work.

Part of the heat available at point 2 of the cycle, after expansion, is recovered and utilized for preheating of the fluid prior to commencement of the cycle, at point 1 of the cycle, with additional heat addition to make up any shortfall.

One example of a novel thermodynamic cycle has been described, above. Further specific, novel modifications of a general class of cycles, based on the above cycle, are now presented.

The novel thermodynamic cycle described above, and the related cycles described now are part of a general class of cycles characterized by the Trilateral Flash Cycle described in U.S. Pat. No. 5,833,446, issued to Smith et al. The Trilateral Flash Cycle is presented in FIG. 6 and may be identified as follows:

Process 1-2 Heat Addition at constant pressure

Process 2-3 Adiabatic, reversible expansion from saturated liquid state at 2

Process 3-4 Constant pressure condensation

The work described in the Smith at al. patent indicates the Trilateral Flash Cycle is suitable for low grade and geothermal heat recovery and highly suited to utilization with organic fluids. Smith et al. were unable to identify any wider range of suitable application for the particular cycle they describe.

During any Rankine cycle process in the wet vapor region, heat may be recovered during expansion. The quantity of heat recovered affects the improvement achieved in the power output and the efficiency.

Figure 6:
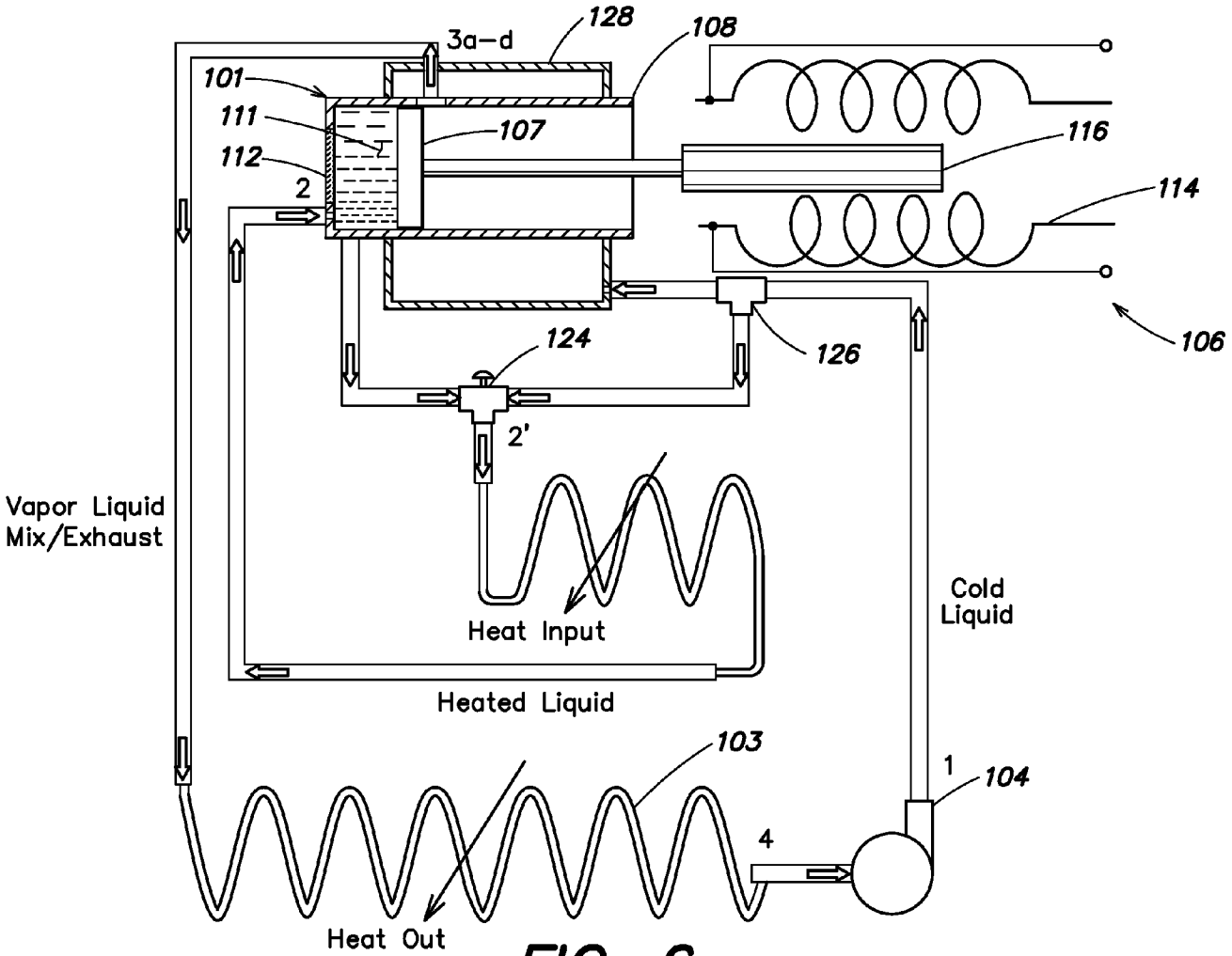
FIG. 6 is a schematic block diagram of a system implementing a proposed thermodynamic cycle including a variable bypass.
Figure 7:
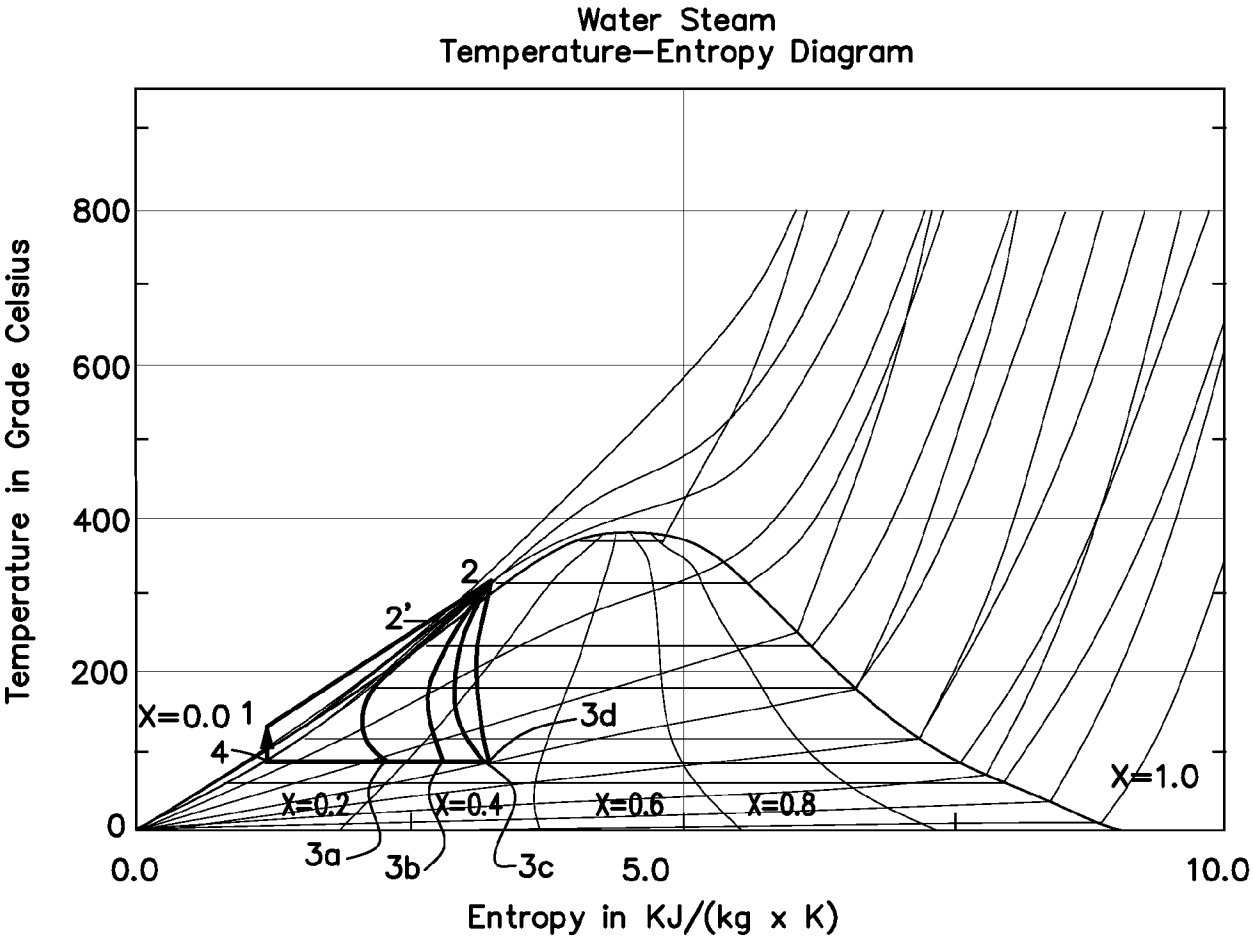
FIG. 7 depicts the variable bypass thermodynamic cycle laid out on a steam T-s diagram.
Figure 8:
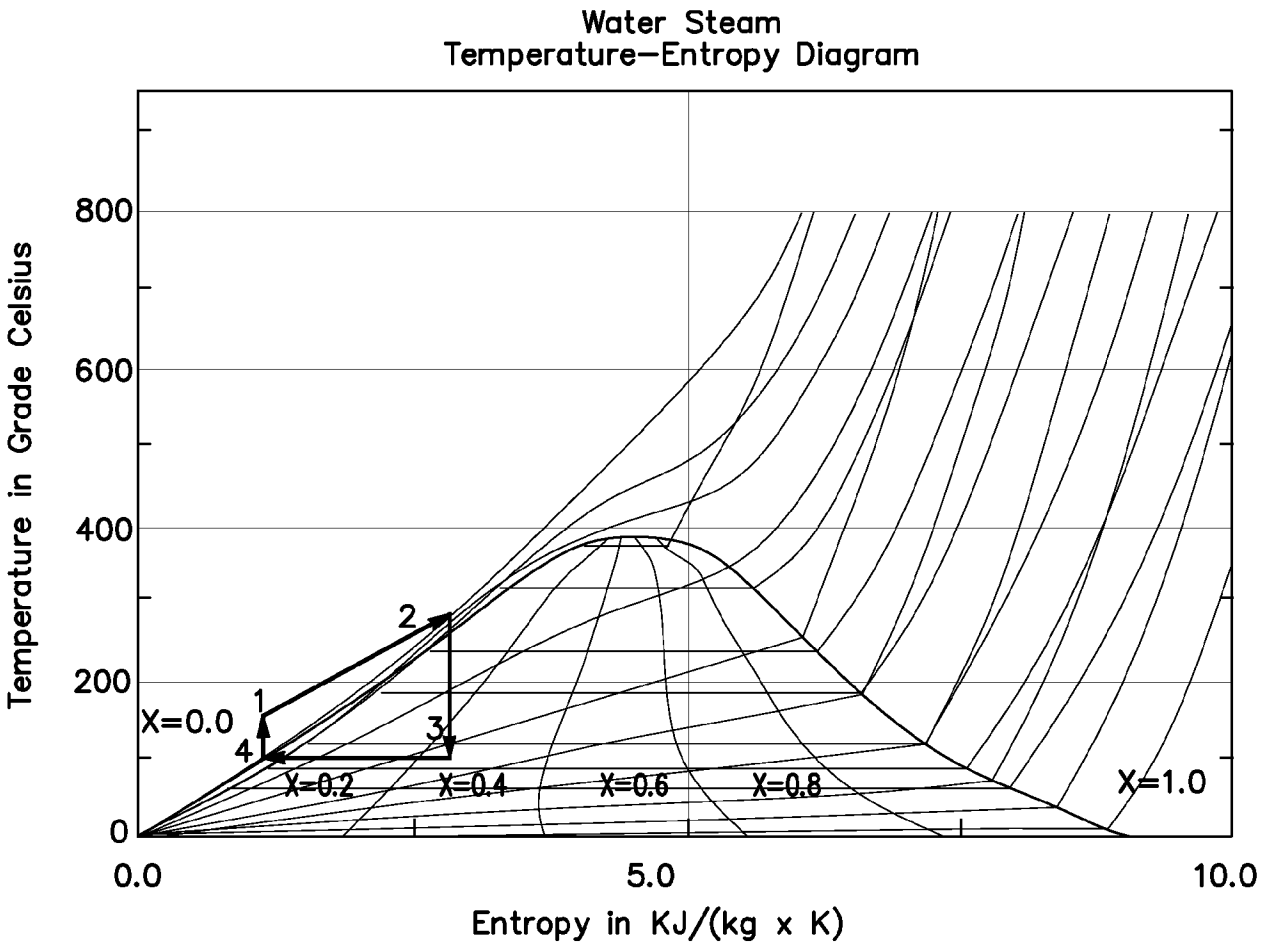
FIG. 8 depicts the variable bypass thermodynamic cycle for the special case of a bypass ratio of 1:1 laid out on a steam T-s diagram.

According to an aspect of an embodiment, as illustrated by FIG. 6, a mixing valve 124 and a heat recovery jacket 128 can be employed for purposes of varying heat quantity recovered during expansion. A representation of the resulting process on a conventional T-s diagram is given in FIG. 7. One parameter helpful to defining the general class of cycles to which embodiments of the invention belong is the bypass ratio, which is defined as the ratio of feed liquid mass flow in the heat recovery jacket to the total feed liquid mass flow.

This bypass ratio may theoretically vary from 0 to 1 but very low bypass ratios result in low specific power outputs hence a more practical approach would be in the range 0.2 to 1.0. The expansion processes resulting from finite stepwise variation of bypass flow is generally shown as lines 2-3a, 2-3b, 2-3c etc. In each of these cases, there is a progressive increase in specific power output and a decrease in overall efficiency as the line from 2-3n approaches vertical (not shown).

To describe the cycle more fully, feedwater at point 1 is pressurized by the pump (see FIG. 6) and sent to bypass splitter 126 where the flow is divided into a portion flowing through the heat recovery jacket and a portion flowing through a bypass line. The two flows are mixed at point 2' and the mixed flow proceeds to the heater. As mentioned the bypass ratio may be varied to let more or less liquid flow through the heat recovery jacket, resulting in varying quantities of heat recovered by and introduced into the feedwater flow. As a result of varying bypass flow, point 2' on the feedwater or pressurized liquid side of the cycle varies up and down, in relation to point 2 where the expansion starts. Low bypass ratio results in the point 2' being raised and coming closer to point 2 (higher efficiency, lower specific power output); whereas higher bypass ratio results in lowering of point 2' in relation to 2 (lower efficiency, higher specific power output). Process 2'-2 represents the heat added in the heater.

The Trilateral Flash Cycle identified by Smith et al. is a special case of the general class of liquid to vapor expansion bypass cycles, with a bypass ratio equal to 1, thereby resulting in a high specific power output but a low overall efficiency, for this class of cycles.

Figure 9:
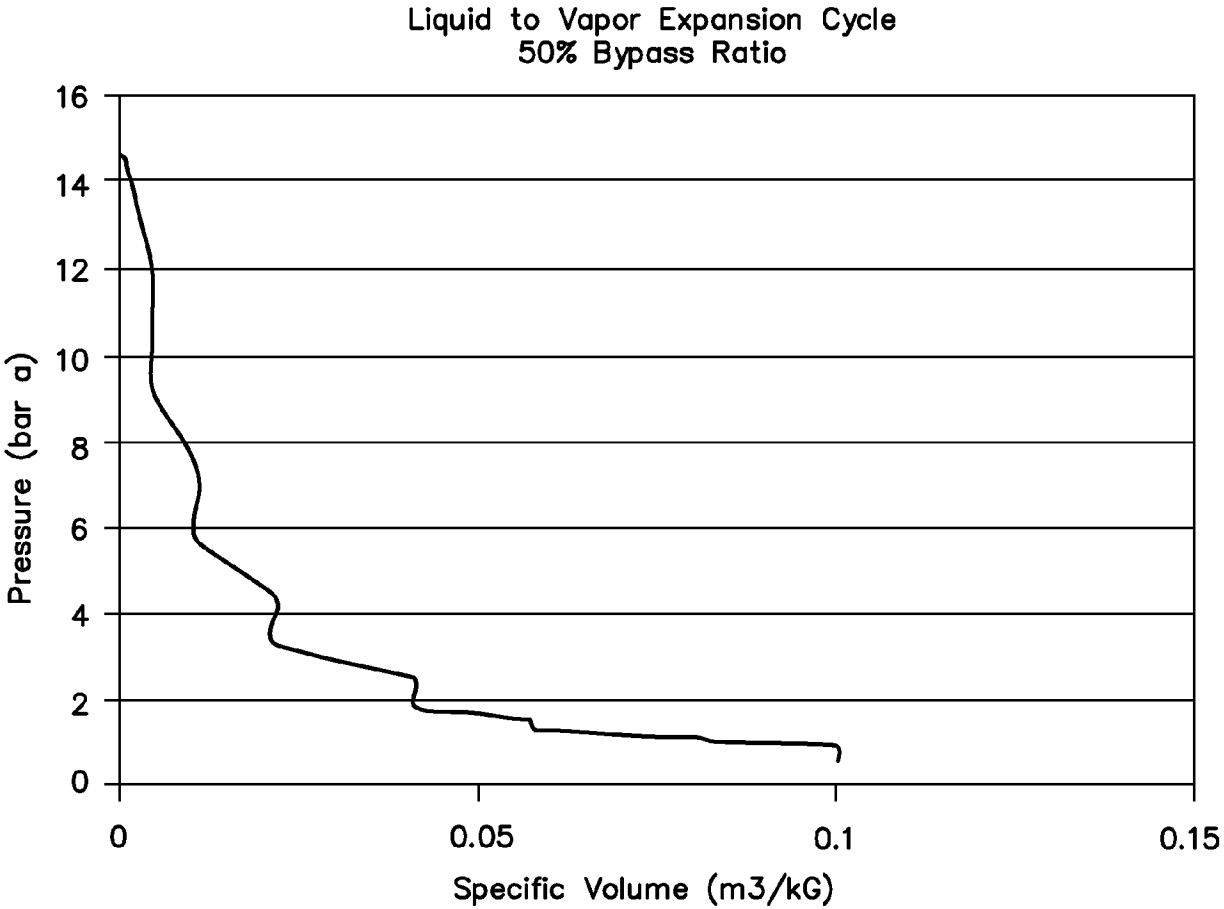
FIG. 9 is a pressure-volume graph showing the effect of a 50% bypass ratio.

A conventional Rankine cycle calculation may be applied to the liquid to vapor expansion bypass cycle; the resulting pressure volume diagram is given in FIG. 9. The calculation is carried out in a finite number of steps and consists of a pair of calculations in each step, namely a reversible, isentropic expansion followed by a constant volume heat recovery, by means of the heat transfer through the cylinder jacket to the feedwater. Typical results obtained were as follows, utilizing water as the working fluid:

| Starting pressure | Condenser pressure | Liquid to vapor bypass cycle efficiency Bypass ratio 50% | Trilateral flash efficiency Bypass ratio 100% |
|---|---|---|---|
| 15.5 Bar a | 0.6 bar a | 25.4% | 13.8% |

Although it was not apparent to Smith et al., we have discovered that lower bypass ratios lead to a substantial efficiency increase. As a result of these high efficiencies water, which is readily available in many locales, may be used as the working fluid, whereas Smith et al. propose organic fluids due to perceived low efficiencies using water. Low efficiency using water in the trilateral cycle appears unavoidable in the literature, but we have discovered that low bypass ratio cycles lift this ceiling and permit consideration of water as a working fluid.

Figure 10:
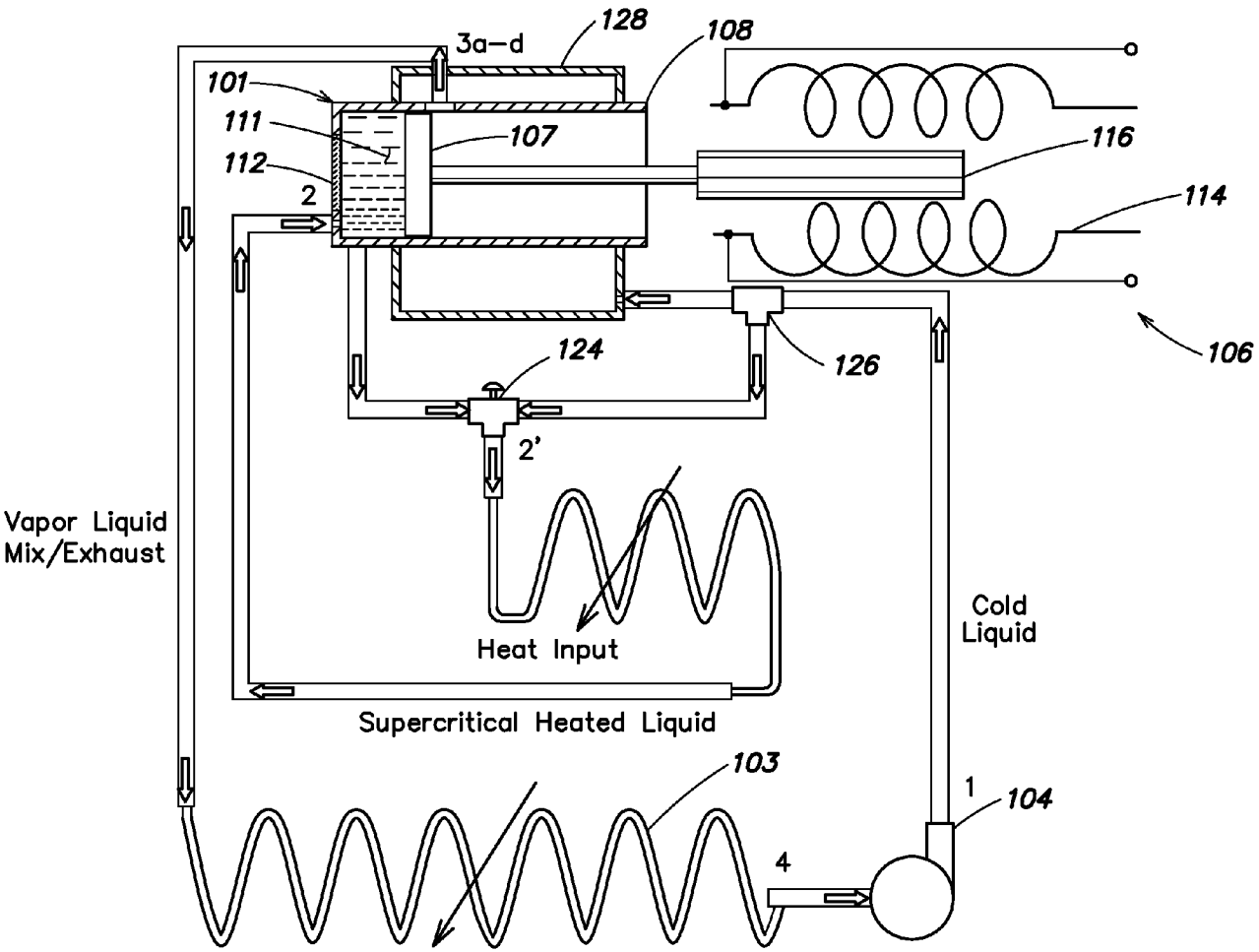
FIG. 10 is an overall schematic of another system implementing a proposed thermodynamic cycle showing the major elements.
Figure 11:
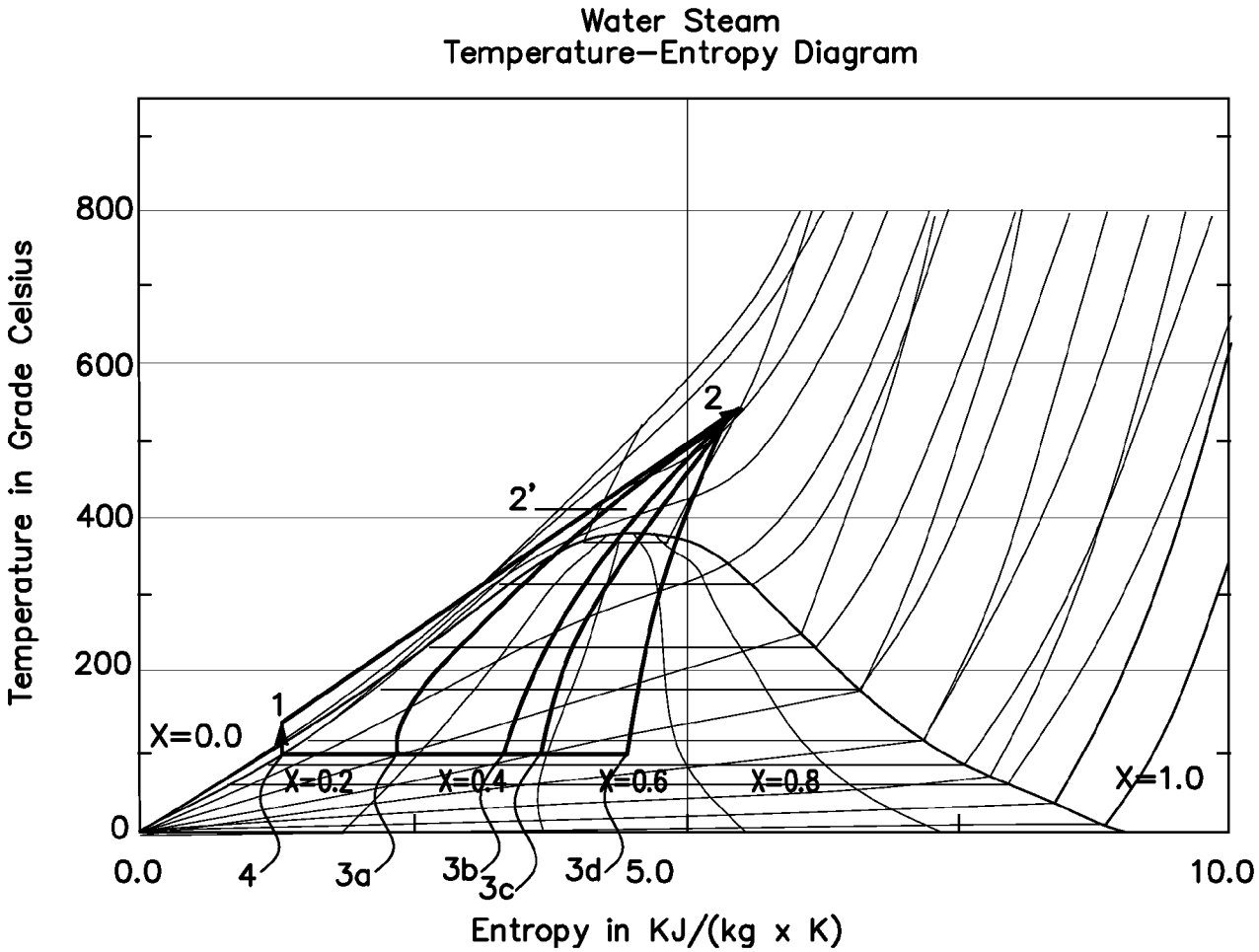
FIG. 11 depicts the thermodynamic cycle laid out on a steam T-s diagram.

The new cycle with bypass may be logically and rationally extended to the supercritical region of the fluid, see FIG. 10 for a schematic and FIG. 11 for the cycle diagram. The method of operation of the system is exactly the same as in the wet region, except for much higher pressures and significantly higher temperatures. Because there is no constant pressure liquid to vapor conversion, the cycles are seamlessly changeable just in terms of pressure and temperature, with the same bypass heat recovery system applicable in all cases.

The new cycle when extended to the superheated region shows higher efficiency than in the wet vapor region, in keeping with Carnot efficiency temperature dependence correlations. There is, however, substantial improvement in work done per unit mass of fluid, which is clearly apparent from the fact that internal energy and enthalpy are much higher in the supercritical region. A cycle with a reversible, adiabatic expansion directly from point 2 down to condensing temperature and pressure, as in the case of the trilateral flash cycle of FIG. 9, is possible and once again becomes a special case, with a bypass ration of 1. There is no art known to this inventor suggesting the special case of a supercritical cycle bypass ratio 1 expansion (reversible adiabatic) to condensing temperature.

The general class of liquid to vapor expansion cycles in the wet vapor and supercritical region with bypass constitute a new class of thermodynamic cycles and provides enhanced efficiency possibilities in a multitude of applications: fixed bypass ratio systems may be used in constant output applications such as geothermal power generation; and, variable bypass ratio systems may be considered for hybrid vehicle applications, wherein a low bypass ratio is used during cruising only to charge a battery at a high efficiency, with a momentary high bypass ratio used to produce higher power output for overtaking, etc.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of converting energy from one form to another by passing a working material through a closed liquid-vapor thermodynamic cycle, comprising:

expanding at least a portion of the working material from a liquid phase into a vapor phase by addition of heat;

recovering heat from the working material after expanding; condensing the working material, after recovering heat, from the vapor phase into the liquid phase, in a condenser, thus restoring the working material to a state where the working material awaits expansion to start a new cycle;

varying the quantity of heat recovered by varying a bypass of the working material during recovering heat from the working material, so as to vary thermodynamic efficiencies and select desired specific work output; and adding the recovered heat to working material awaiting expansion, without changing the phase thereof; whereby efficiency of the method is improved over a method lacking recovering heat.

2. An engine comprising:

a chamber defined by at least one fixed wall and at least one movable wall, the volume of the chamber variable with movement of the movable wall;

an injector arranged to inject liquid without expansion into the chamber while the chamber has a substantially minimum volume;

apparatus constructed and arranged to introduce energy into the chamber at a rate sufficient to explosively vaporize the liquid, performing work on the movable wall;

apparatus constructed and arranged to return the movable wall to a position prior to the work being performed thereon so the chamber has the substantially minimum volume; and a valve constructed and arranged to substantially evacuate the chamber of vaporized fluid without substantially compressing the vaporized fluid, wherein the moveable wall comprises a face of a piston, the piston including a groove, the piston configured such that the groove is aligned with an exhaust port in the fixed wall of the chamber after work is performed on the moveable wall, and wherein the apparatus constructed and arranged to return the movable wall to a position prior to the work being performed thereon comprises a spring constructed and arranged to exert a force on the piston in a direction toward a portion of the fixed wall.

3. The engine of claim 2, wherein the spring is constructed and arranged to rotate the piston upon a movement of the piston through the chamber.

4. An engine comprising:

a chamber defined by at least one fixed wall and at least one movable wall, the volume of the chamber variable with movement of the movable wall;

an injector arranged to inject liquid without expansion into the chamber while the chamber has a substantially minimum volume;

apparatus constructed and arranged to introduce energy into the chamber at a rate sufficient to explosively vaporize the liquid, performing work on the movable wall;

apparatus constructed and arranged to return the movable wall to a position prior to the work being performed thereon so the chamber has the substantially minimum volume; and a valve constructed and arranged to substantially evacuate the chamber of vaporized fluid without substantially compressing the vaporized fluid, and further comprising a heat recovery jacket surrounding at least a portion of the engine and in fluid communication with a heat exchanger, an input to the heat exchanger in fluid communication with the valve, and an output of the heat exchanger in fluid communication with the injector.

5. The engine of claim 4, further comprising a bypass splitter in fluid communication with the injector, the heat recovery jacket, and a bypass line, the bypass splitter constructed and arranged to divide a portion of the liquid to be injected into the chamber into a portion flowing through the heat recovery jacket and a portion flowing through the bypass line.

6. The method of claim 1, wherein the working material is expanded within a chamber and the working material is not compressed in the chamber prior to expanding the working material.

7. The method of claim 6, wherein heating the working material in the liquid phase takes place at near constant volume and the expansion takes place while heat is being input.

8. The method of claim 7, wherein expanding the working material from a liquid phase into a vapor is performed at a constant temperature and pressure.

9. The method of claim 7, wherein expanding the working material from a liquid phase into a vapor is performed in a reversible, adiabatic cycle, wherein internal energy within the cycle is converted to mechanical work.

10. The method of claim 8, further comprising exhausting working material in the vapor phase from the chamber, the working material in the vapor phase maintaining at a constant volume.

11. The method of claim 10, wherein recovering heat from the working material in the vapor phase is performed with the working material in the vapor phase maintained at a constant temperature and pressure.

12. The method of claim 10, wherein recovering heat from the working material in the vapor phase is performed with the working material in the vapor phase maintained at a constant volume.

13. The method of claim 11, wherein the working material in the vapor phase is condensed at a constant pressure and temperature.

14. The method of claim 13, wherein recovering heat from the working material in the vapor phase comprises adding the recovered heat to working material awaiting expansion while maintaining a constant volume of the working material awaiting expansion.

15. The method of claim 14, wherein the temperature of the system is maintained at a constant level as energy is added to the system.

16. The method of claim 1, wherein varying a bypass of the working material during recovering heat from the working material comprises varying a ratio of feed liquid mass flow in a heat recovery jacket to a total feed liquid mass flow, the heat recovery jacket surrounding a portion of an engine in which the method is performed.

17. The method of claim 16, further comprising decreasing a specific power output of the engine while increasing the thermodynamic efficiency of the engine by increasing the ratio of feed liquid mass flow in the heat recovery jacket to the total feed liquid mass flow.

18. The method of claim 17, wherein the working material is water.

19. The method of claim 18, further comprising putting the water in a supercritical state.

* * * * *